US006698863B2

(12) United States Patent
King et al.

(10) Patent No.: US 6,698,863 B2
(45) Date of Patent: Mar. 2, 2004

(54) METHODS AND APPARATUS FOR CLEANING AN INKJET PRINT HEAD

(75) Inventors: William F. King, Eagle, ID (US); Eric L. Ames, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 28 days.

(21) Appl. No.: 10/122,444

(22) Filed: Apr. 13, 2002

(65) Prior Publication Data

US 2003/0193540 A1 Oct. 16, 2003

(51) Int. Cl.[7] ..... B41J 2/165
(52) U.S. Cl. ..... 347/22; 347/31
(58) Field of Search ..... 347/22, 32, 33, 347/31, 29, 36

(56) References Cited

U.S. PATENT DOCUMENTS 4,223,322 A * 9/1980 van Raamsdonk ..... 347/31
4,369,456 A * 1/1983 Cruz-Uribe et al. ..... 347/33
4,437,105 A * 3/1984 Mrazek et al. ..... 347/29
5,239,316 A * 8/1993 Demarchi et al. ..... 347/33

FOREIGN PATENT DOCUMENTS

EP 0 316 198 * 5/1989

* cited by examiner

*Primary Examiner*—Shih-wen Hsieh

(57) ABSTRACT

Apparatus and methods of cleaning the nozzle area and the ink nozzle of a print head of an inkjet imaging apparatus include devices of moving the nozzle area into contact with an imaging media, wherein the nozzle area is moved relative to the imaging media to thereby scrub contaminants and the like from the nozzle area and the ink nozzle. The is accomplished by way of an actuating mechanism that can be configured either to move the print head or to move a backup object which, in turn, moves the imaging media. The print head can be configured to spray ink onto the imaging media just prior to bringing the nozzle area and imaging media into contact with one another, wherein the wet ink can have a solvent effect during the scrubbing of the nozzle area against the imaging media.

20 Claims, 5 Drawing Sheets

METHODS AND APPARATUS FOR CLEANING AN INKJET PRINT HEAD

FIELD OF THE INVENTION

The invention claimed and disclosed herein pertains to inkjet imaging apparatus, and more specifically, to methods and apparatus for cleaning print heads of inkjet imaging apparatus.

BACKGROUND OF THE INVENTION

Many types of prior art imaging apparatus are known. The term "imaging apparatus" generally encompasses any device that is configured to produce an image on an imaging media such as paper or the like. Imaging apparatus are employed in various types of devices including printers, photocopiers, facsimile machines, and the like, as well as combinations thereof which are capable of performing multiple functions. The two main categories of imaging apparatus are those of impact and non-impact imaging apparatus. Impact imaging apparatus include both the dot matrix and the character types. Non-impact imaging apparatus include inkjet, laser, solid ink, dye-sublimation, thermal wax, and thermal auto-chrome types of imaging apparatus. One of the most popular types of imaging apparatus is that of the inkjet, because of its relatively low cost and its capability to produce relatively high-quality images.

Inkjet imaging apparatus employ one or more nozzles to spray very small, individual droplets of ink onto the imaging media to form the image. These droplets can be generated in any of a number of different manners, such as by thermally heating the ink in the nozzle to cause it to boil, or by oscillating a piezoelectric crystal in the nozzle to force ink from the nozzle. Each droplet of ink that is sprayed by the nozzle forms a corresponding ink spot on the imaging media. The spots are extremely small and generally blend together to form the overall image on the imaging media. Monochromatic inkjet imaging apparatus are generally used for printing only text and/or monochromatic graphics, and employ a single color of ink, which is usually black. Color inkjet imaging apparatus are capable of producing images containing any of a wide range of colors. Such color inkjet imaging apparatus generally employ several colors of ink which usually include the colors of cyan, magenta, yellow, and black.

Inkjet imaging apparatus include at least one print head that supports one or more ink nozzles. The inkjet imaging apparatus also includes an imaging media feed system and a print head control system. The imaging media feed system, in conjunction with a controller or the like, is configured to feed the imaging media along a media path in a precisely and accurately controlled manner. The imaging media feed system generally comprises a plurality of feed rollers which are driven by a stepper motor or the like, and which contact the imaging media to feed the imaging media along the media path.

The print head control system, on the other hand, is configured to move the print head laterally across the media path, also in a precisely and accurately controlled manner. In order to perform this task, the print head control system generally comprises a lateral positioning mechanism that generally includes a stabilizer bar and a belt that is attached to the print head and driven by a stepper motor or the like. The controller, which is mentioned above, is generally employed to control the actuation of the stepper motor in a precisely and accurately controlled manner so as to position the print head relative to the imaging media.

Thus, to produce an image on the imaging media, the controller for the inkjet imaging apparatus causes the imaging media control system to move the imaging media along the media path while also causing the print head control system to move the print head laterally across the media path. While this occurs, the controller also causes the print head to spray droplets of ink from the ink nozzle onto the imaging media. That is, as the imaging media is advanced along the media path, the print head traverses across the imaging media while the ink nozzle sprays ink droplets onto the imaging media. The image is thus formed by way of precise and accurate control of the movement of both the print head and the imaging media, as well as precise and accurate control of the ink spray from the ink nozzle.

Most prior art inkjet imaging apparatus include a service station. The service station is an area where the print head, or heads, are "parked" when not in use. Some prior art inkjet imaging apparatus service stations are equipped to perform cleaning operations to the print head to remove residual amounts of ink from the ink nozzle area. Residual ink can build up in the area of the ink nozzles as the result of the ink spraying operation performed by the nozzles. Such residual amounts of ink can clog the ink nozzle or impede the proper trajectory of the ink droplets as they are sprayed from the ink nozzle to the imaging media. Clogged ink nozzles and/or impeded flow of the ink droplets can result in various deleterious effects including degraded image quality and increased buildup of residual ink in the area surrounding the nozzle. Although the prior art inkjet imaging apparatus can produce satisfactory images, several disadvantages can be associated with the service stations that are often included in prior art inkjet imaging apparatus.

A primary disadvantage that can be associated with the prior art inkjet imaging apparatus service stations is that of size. That is, a significant portion of a typical prior art inkjet imaging apparatus having a service station is dedicated to accommodating the inclusion of the service station in the imaging apparatus. In other words, the inclusion of a service station in prior art inkjet imaging apparatus generally adds significantly to the overall size of the apparatus. Additionally, the results of inkjet nozzle cleaning operations associated with the prior art inkjet imaging apparatus service stations are sometimes less than satisfactory.

What is needed then are information system methods and apparatus which achieve the benefits to be derived from similar prior art methods and/or devices, but which avoid the shortcomings and detriments individually associated therewith.

SUMMARY OF THE INVENTION

The present invention provides for cleaning the print head of an inkjet imaging apparatus by utilizing imaging media as a cleaning device. More specifically, in accordance with the present invention, an imaging media and the nozzle area of a print head of an inkjet imaging apparatus are brought into contact with one another, wherein during such contact the nozzle area is moved across the media to "scrub" or remove contaminants and foreign matter, such as dried ink, from the nozzle area. Also in accordance with the present invention, ink from the print head can be sprayed onto the media before the nozzle are and media are brought into contact, wherein the wet ink has a solvent effect during the scrubbing process.

In accordance with one embodiment of the present invention, an in inkjet imaging apparatus includes an actuating mechanism that is configured to bring the nozzle area and the media into contact with one another for the scrubbing process. The actuating mechanism can be configured to move the print head into contact with the media while the media remains on the media path. Alternatively, the actuating mechanism can be configured to move the media off of the media path and into contact with the nozzle area.

These and other aspects and embodiments of the present invention will now be described in detail with reference to the accompanying drawings, wherein:

DETAILED DESCRIPTION OF THE INVENTION

Apparatus and methods in accordance with the instant invention are intended to provide for cleaning of the print head of an inkjet imaging apparatus. In accordance with one embodiment of the invention, an inkjet imaging apparatus includes a print head having a nozzle area and an ink nozzle defined in the nozzle area. The apparatus also includes an actuating mechanism configured to bring an imaging media and the nozzle area of the print head into contact with one another to facilitate cleaning of the nozzle area and the ink nozzle.

In accordance with another embodiment of the present invention, an imaging apparatus as described above is provided, wherein the print head is configured to be moved into contact with the imaging media by the actuating mechanism. In accordance with yet another embodiment of the present invention, an imaging apparatus has a print head, an actuating mechanism, and a backup object. The actuating mechanism is configured to move the backup object into contact with the imaging media so as to move the imaging media into contact with the nozzle area of the print head.

In accordance with yet another embodiment of the present invention, an inkjet imaging apparatus includes a chassis, a media path, an actuating mechanism, a lateral positioning mechanism, and a print head. The lateral positioning mechanism is configured to move the print head across the imaging media while the print head and imaging media are in contact with one another. The print head is supported on the lateral positioning mechanism which, in turn, is supported on the actuating mechanism. In accordance with an alternative embodiment of the instant invention, an imaging apparatus includes the aforementioned elements, but the print head is supported on the actuating mechanism which, in turn, is supported on the lateral positioning mechanism.

In accordance with still another embodiment of the instant invention, an inkjet imaging apparatus includes a chassis, a media path, a lateral positioning mechanism, a print head supported on the lateral positioning mechanism, an actuating mechanism, and a backup object that is supported on the actuating mechanism. The actuating mechanism is configured to move the imaging media off the media path and into contact with the nozzle area of the print head. The lateral positioning mechanism is configured to move the nozzle area across the imaging media while the imaging media and the nozzle area are in contact with one another.

In accordance with an additional embodiment of the present invention, a method of cleaning a nozzle area and an ink nozzle of a print head includes moving the nozzle area into contact with the imaging media. Conversely, an alternative method of cleaning a nozzle area and ink nozzle includes moving the imaging media into contact with the nozzle area.

Figure 1:
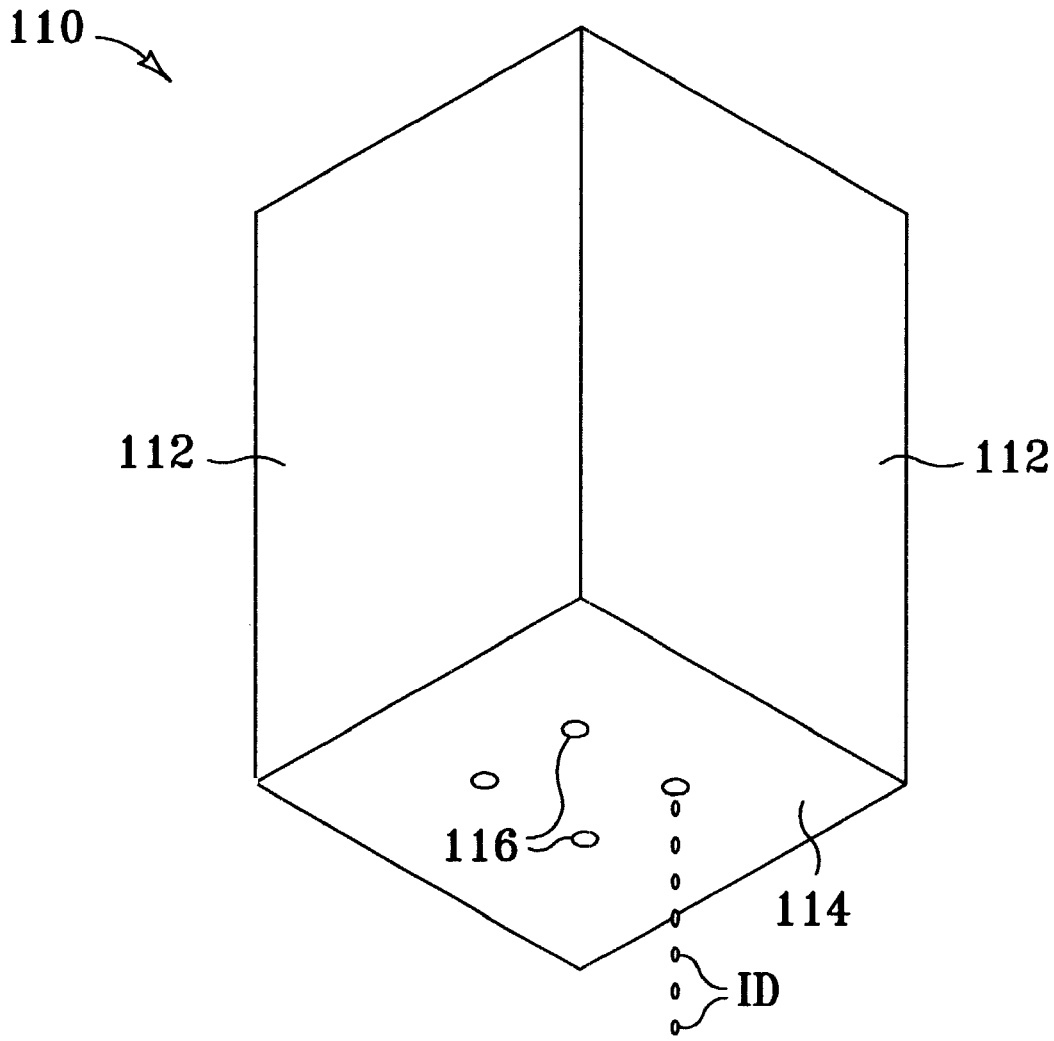
FIG. 1 is an isometric view that depicts the print head in accordance with the present invention.

With reference now to FIG. 1, a simplified isometric view is shown which depicts a print head 110 in accordance with the present invention. The print head 110 can be similar to known prior art print heads. The print head 110 has at least one side 112, and preferably has a plurality of sides. The print head 110 also defines a nozzle area 114 as shown. At least one ink nozzle 116 is located in the nozzle area 114. The nozzle 116 can be, for example a simple orifice that is defined in the print area 114. The ink nozzle 116 is configured to spray, or otherwise eject, ink droplets ID as explained above with respect to the prior art. That is, the print head 110 is configured to spray ink droplets ID from the nozzle 116 onto a sheet of imaging media (not shown) in order to produce an image on the imaging media.

Figure 2:
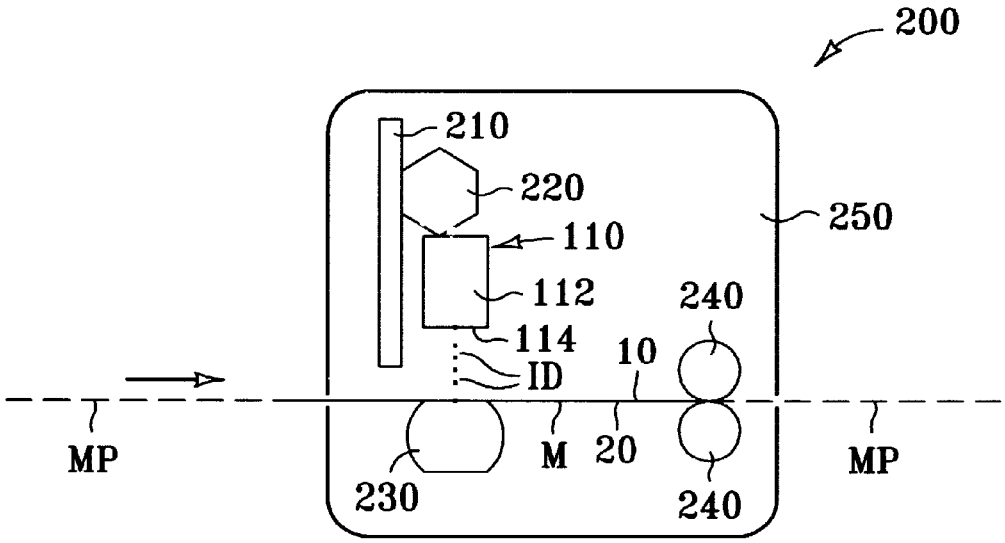
FIG. 2 is a schematic diagram that depicts an inkjet imaging apparatus in accordance with one embodiment of the present invention.

Turning to FIG. 2, a schematic diagram is shown which depicts an inkjet imaging apparatus 200 in accordance with one embodiment of the present invention. The inkjet imaging apparatus 200 is configured to produce an image (not shown) on an imaging media M. The imaging media M can be, for example, a sheet of paper or the like. As is shown, the imaging media M has a first side 10 and an opposite second side 20. The inkjet imaging apparatus 200 is configured to produce an image on the first side 10 of the imaging media M by spraying ink droplets ID onto the first side of the imaging media.

The inkjet imaging apparatus 200 comprises a print head 110 which has been described above with reference to FIG. 1. As is seen in FIG. 2, the print head 110 defines a nozzle area 114. The ink droplets ID can be sprayed onto the first side 10 of the imaging media M from at least one nozzle (not shown) that is located in the nozzle area 114 as described above with reference to FIG. 1. Still referring to FIG. 2, the inkjet imaging apparatus 200 comprises an actuating mechanism 210 that will be discussed in greater detail below.

As is shown, the inkjet imaging apparatus 200 preferably includes a lateral positioning mechanism 220, as well as a backup object 230. The lateral positioning mechanism 220 as well as the backup object 230 will be discussed in greater detail below. The inkjet imaging apparatus 200 also preferably includes a feed mechanism 240. The feed mechanism 240 is configured to move the imaging media M along a media path MP. The media path MP is configured to convey the imaging media M there along relative to the chassis 250. The media path MP preferably comprises various known components which are configured to facilitate movement of the imaging media M through the inkjet imaging apparatus 200 and along the media path. Such known components can include, for example, various guides, gates, tracks, and the like (not shown).

As is also shown in FIG. 2, the inkjet imaging apparatus 200 preferably comprises a chassis 250 that can act as a support for various other components of the apparatus. For example, the actuating mechanism 210, as well as the backup device 230 and the feed mechanism 240 of the apparatus 200, are preferably supported on the chassis 250. As is also seen from a study of FIG. 2, the lateral positioning mechanism 220 of the apparatus 200 is supported on the actuating mechanism 210. Similarly, the print head 110 of the apparatus 200 is supported on the lateral positioning mechanism 220.

The actuating mechanism 210 is configured to bring the nozzle area 114 and the imaging media M into contact with one another to facilitate cleaning of the nozzle area and the ink nozzle (shown in FIG. 1). That is, the inkjet imaging apparatus 200 is configured such that the actuating mechanism 210 moves the print head 110, and thereby brings the nozzle area 114 into contact with the imaging media to facilitate cleaning of the nozzle area and the ink nozzle. It is understood that the lateral positioning mechanism 210 can be configured in one of many possible manners. For example, the lateral positioning mechanism 210 can be configured as an actuator such as a pneumatic or hydraulic actuator. Alternatively, the lateral positioning mechanism 210 can be configured as a linear motor or the like.

The backup object 230 is configured to contact and support the second side 20 of the imaging media M when the nozzle area 114 of the print head 110 is in contact with the first side of the imaging media. In other words, the backup object 230 is configured to contact and support the second side 20 of the imaging media M substantially opposite of the nozzle area 114, wherein the imaging media is sandwiched between the backup object and the nozzle area when the nozzle area and the first side of the imaging media are brought into contact with one another.

Figure 8:
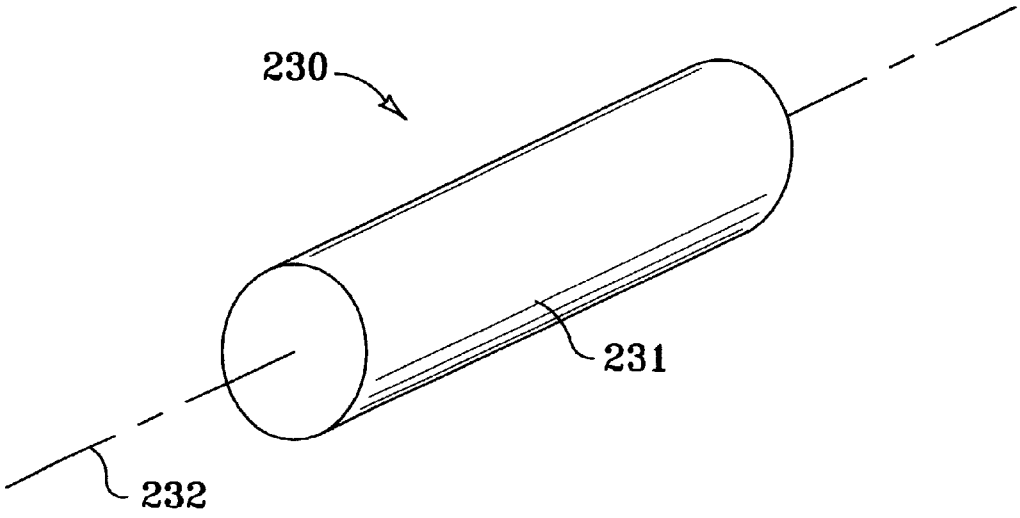
FIG. 8 is an isometric view of an alternative configuration of the backup object of the present invention.
Figure 9:
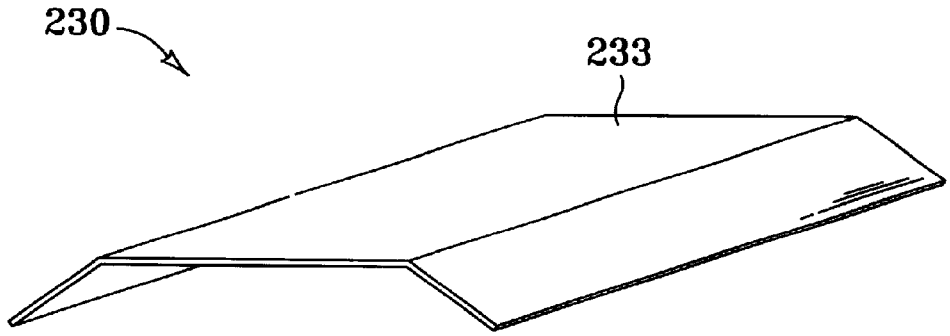
FIG. 9 is an isometric view of another alternative configuration of the backup object of the present invention.

It is understood that the backup object 230 can have one of several possible configurations. For example, turning briefly to FIG. 8, an isometric view is shown which depicts the backup object 230 in accordance with one embodiment of the present invention. That is, in accordance with one embodiment of the present invention, the backup device 230 can comprises a roller 231 that is configured to be rotated about an axis of rotation 232. Thus, the roller 231 can act to support the second side 20 of the imaging media M. Now briefly turning to FIG. 9, an isometric view is shown which depicts the backup object 230 in accordance with another embodiment of the present invention. That is, in accordance with an alternative embodiment of the present invention, the backup object 230 can comprise a plate 233 that is configured to support the second side 20 of the imaging media M.

Figure 3:
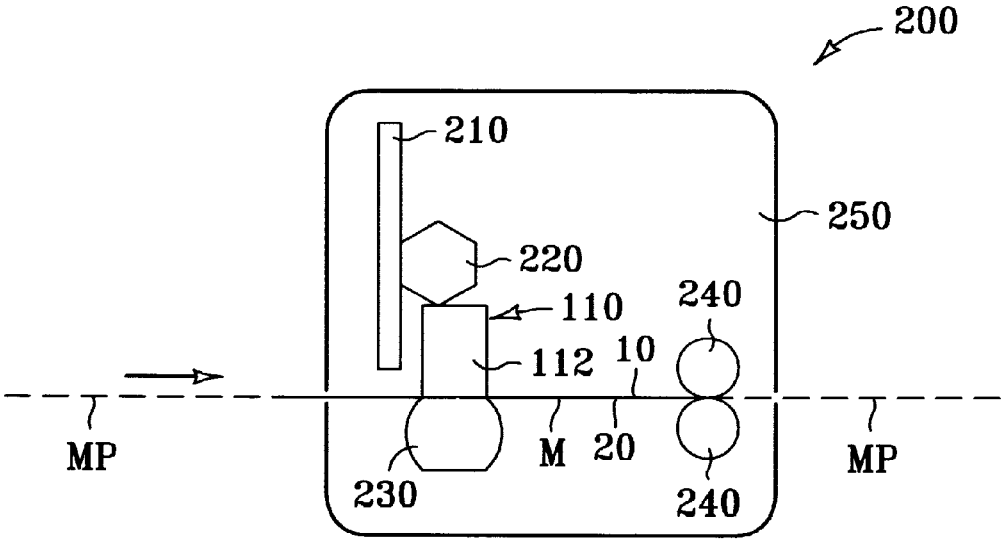
FIG. 3 is a schematic diagram of the inkjet imaging apparatus that is depicted in FIG. 2, and which shows movement of the print head.

Now moving to FIG. 3, a schematic diagram is shown which depicts the inkjet imaging apparatus 200 that is shown in FIG. 2. In FIG. 3, however, the print head 110 is shown as being moved relative to the chassis 250 so as to bring the nozzle area (shown in FIG. 2) into contact with the first side 10 of the imaging media M. Further examination of FIG. 3 reveals that the actuating mechanism 210 is configured to move the print head 110, and to thereby bring the nozzle area into contact with the imaging media to facilitate cleaning of the nozzle area the ink nozzle (shown in FIG. 1). As is also shown in FIG. 3, in the case wherein a lateral positioning mechanism 220 is included in the apparatus 200, the actuating mechanism 210 is also configured to move the lateral positioning mechanism along with the print head 110.

When the nozzle area 114 and the imaging media M are brought into contact with one another by way of the actuating mechanism 210, the imaging media can be moved relative to the nozzle area, or vice versa, in such a manner that the imaging media and the nozzle area slide against one another. This sliding of the imaging media M and the nozzle area 114 against one another creates an abrading or rubbing action that can serve to clean dried ink and the like from the nozzle area and/or the ink nozzle itself. Preferably, the imaging media M contains a wet ink spot that contacts the nozzle area 114 during contact of the nozzle area and the media. This is preferable because the wet ink has been found to act as a solvent with respect to any dried ink that has adhered to the nozzle area 114 and/or the ink nozzle.

The sliding, or rubbing, of the imaging media M and the nozzle area 114 against one another can be accomplished in one of several manners. For example, the imaging media M can be moved along the media path MP while the print head 110 is in contact with the imaging media. That is, the imaging media M can be sandwiched between the print head 110 and the backup object 230 by way of the actuating mechanism as explained above, during which the imaging media continues to be moved along the media path MP. The movement of the imaging media M along the media path MP while also sandwiched between the print head 110 and the backup object 230 can result in an abrading or rubbing action with respect to the first side 10 of the imaging media and the nozzle area.

Alternatively, and preferably, the sliding, or rubbing, or the imaging media M and the nozzle area 114 (shown in FIG. 2) against one another is accomplished by way of the lateral positioning mechanism 220. The lateral positioning mechanism 220 is configured to move the print head 110 in a transverse, or lateral, direction relative to the media path MP. The lateral positioning mechanism 220 can be, for example, configured to move the print head across the imaging media in conjunction with the production of an image (not shown). That is, the lateral positioning mechanism 220 can be configured to move the print head laterally relative to the media path MP so as to enable the print head to spray ink droplets across the imaging media while an image is formed thereon.

Preferably, however, the lateral positioning mechanism 220 is also configured to move the print head 110 across the imaging media M while the nozzle area 114 (shown in FIG. 2) is in contact therewith. More preferably, the imaging media M is at rest, or is not moving relative to the chassis 250, while the print head 110 is moved across the imaging media M by way of the lateral positioning mechanism 220. Most preferably, the print head 110 sprays and area of ink onto the first side 10 of the imaging media M before being moved into contact therewith by way of the actuating mechanism 210. The print head 110 is then most preferably moved into contact with the imaging media M before the area of ink dries.

Then, most preferably, the lateral positioning mechanism 220 moves the print head transversally, or laterally, across the imaging media while the imaging media is sandwiched between the backup object 230 and the nozzle area 114 (shown in FIG. 2). The nozzle area 114 as well as the ink nozzle 116 (shown in FIG. 1) are slide or rubbed against the wet ink area. Such sliding or rubbing of the nozzle area 114 and ink nozzle 116 against the wet ink area on the imaging media M facilitates cleaning of both the nozzle area and the ink nozzle.

It is understood that the lateral positioning mechanism 220 can be configured in any of several possible manners and can include various components such as linear slides (not shown) and/or at least one actuator (not shown) having one of many possible configurations, and the like. Furthermore, it is understood that the lateral positioning mechanism 220 can be a prior art mechanism (not shown) that is employed to move a prior art print head laterally across an imaging media to facilitate, and in conjunction with, the production of an image thereon.

Figure 4:
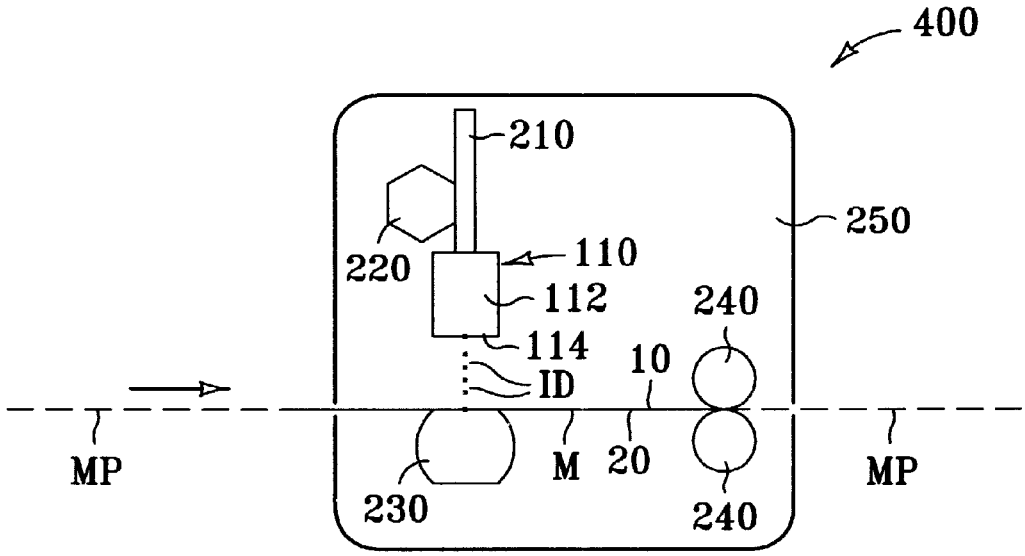
FIG. 4 is a schematic diagram that depicts an inkjet imaging apparatus in accordance with another embodiment of the present invention.

With reference now to FIG. 4, a schematic diagram is shown which depicts an inkjet imaging apparatus 400 in accordance with another embodiment of the present invention. The inkjet imaging apparatus 400, which is depicted in FIG. 4, can be substantially identical to the inkjet imaging apparatus 200 which is depicted in FIGS. 2 and 3 with the exception of one major difference. This difference is that the inkjet apparatus 200 can include a lateral positioning mechanism 220 on which the print head 110 can be supported, wherein the lateral positioning mechanism is, in turn, supported on the actuating mechanism 210, while with regard to the inkjet apparatus 400, the relative positions of the lateral positioning mechanism and the actuating mechanism can be reversed.

Still referring to FIG. 4, the inkjet imaging apparatus 400 is configured to produce an image (not shown) on an imaging media M by spraying ink droplets ID onto the imaging media. The inkjet imaging apparatus 400 comprises a print head 110 which has a side 112, and which defines a nozzle area 114. An ink nozzle 116 is located in the nozzle area 114 as described above and shown in FIG. 1. The inkjet apparatus 400 also comprises an actuating mechanism 210 that is configured to bring the nozzle area 114 and the imaging media M into contact with one another to facilitate cleaning of the nozzle area and of the ink nozzle (shown in FIG. 1).

As seen from an examination of FIG. 4, the inkjet imaging apparatus 400 also preferably comprises a lateral positioning mechanism 220, as well as a backup object 230 which have both been described above with regard to the apparatus 200 that is shown in FIGS. 2 and 3. The inkjet imaging apparatus 400, which is shown in FIG. 4, also preferably comprises a feed mechanism 240 and a chassis 250 which have also been described above with regard to the apparatus 200 that is shown in FIGS. 2 and 3. Preferably, the lateral positioning mechanism 220, the backup object 230, and the feed mechanism 240 are supported on the chassis 250.

The print head 110 of the apparatus 400 is preferably supported on the actuating mechanism 210. The actuating mechanism 210 of the apparatus 400 is preferably supported on the lateral positioning mechanism 220. As is further evident from a study of FIG. 4, the inkjet imaging apparatus 400 can comprise a media path MP that is configured to convey the imaging media M there along relative to the chassis 250. The media path MP has been described above with reference to the apparatus 200 which is shown in FIGS. 2 and 3.

As explained above with regard to the inkjet imaging apparatus 200, the actuating mechanism 210 of the apparatus 400 is configured to move the print head 110, and thereby to bring the nozzle area 114 into contact with the imaging media M to facilitate cleaning of the nozzle area and of the ink nozzle (shown in FIG. 1). The lateral positioning mechanism 220, on the other hand, is configured to move the print head 110 laterally, or transversally, across the imaging media M while the nozzle area 114 is in contact with the imaging media to further facilitate cleaning of the nozzle area and of the ink nozzle.

Figure 5:
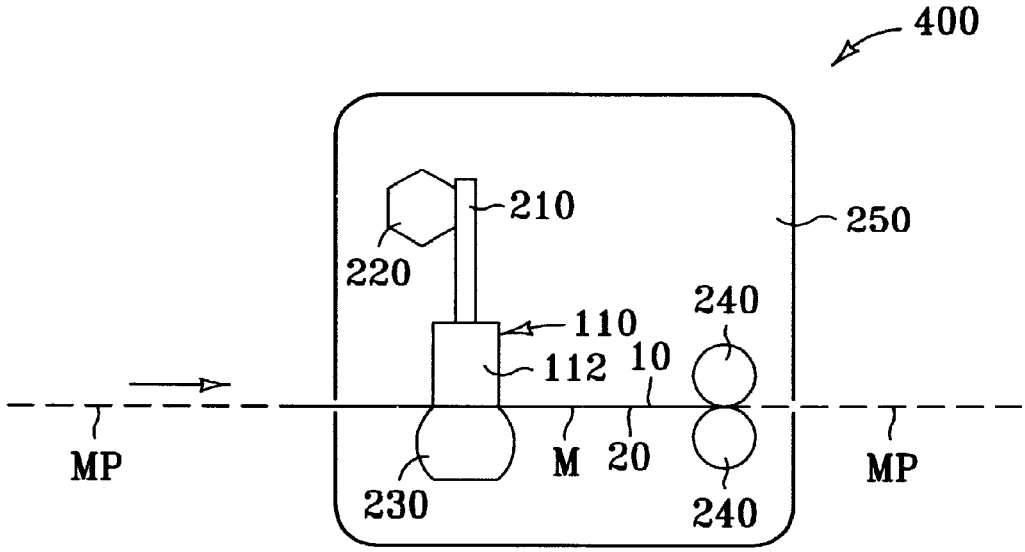
FIG. 5 is a schematic diagram of the inkjet imaging apparatus that is depicted in FIG. 4, and which shows movement of the print head.

Turning now to FIG. 5, a schematic diagram is shown which depicts the inkjet imaging apparatus 400 that is depicted in FIG. 4. An examination of FIG. 5 reveals that the actuating mechanism 210 is configured to move the nozzle area 114 (shown in FIG. 4) into contact with the first side 10 of the imaging media M. Also evident from FIG. 5 is that the backup object 230 is configured to contact and support the second side 20 of the imaging media M substantially opposite of the nozzle area 114 so that the imaging media is sandwiched between the backup object and the nozzle area. This contact of the nozzle area 114 with the imaging media facilitates cleaning of the nozzle area and of the ink nozzle 116 (shown in FIG. 1).

Thus, in operation, the inkjet imaging apparatus 400 moves the nozzle area 114 into contact with the first side 10 of the imaging media M so that the nozzle area and the imaging media are rubbed or slid relative to one another. This can be accomplished, as described above with regard to the apparatus 200, by causing the imaging media M to be moved along the media path MP while the nozzle area 114 is in contact with the imaging media. The sliding, or rubbing, of the nozzle area 114 against the imaging media M can also be accomplished while the imaging media does not move along the media path MP. That is, while the imaging media M remains stationary relative to the chassis 250, and while the nozzle area 114 is in contact with the imaging media M, the lateral positioning mechanism 220 can be made to move the print head 110, and thus the nozzle area 114, across the imaging media in a substantially transverse direction relative to the media path MP.

Preferably, however, the print head 110 is caused to spray an ink area (not shown) onto the first side 10 of the imaging media M before the nozzle area 114 is brought into contact with the imaging media. After the ink area is sprayed onto the imaging media M, and before the ink area dries, the print head 110 is preferably moved by way of the actuating mechanism 210 to thereby bring the nozzle area 114 into contact with the wet ink area. Preferably, the print head 110 is then moved across the imaging 133 media M in a substantially transversal direction by way of the lateral positioning mechanism 220 so as to slide, or rub, the nozzle area 114 against the first side 10 of the imaging media and through the wet ink area. This action can have the effect of cleaning the nozzle area 314 as well as the ink nozzle.

Figure 6:
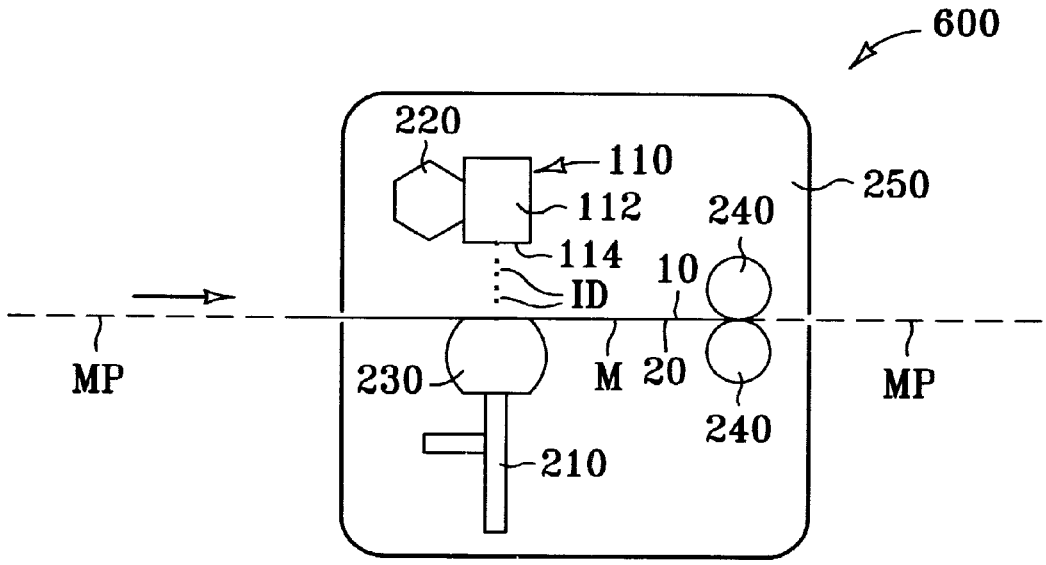
FIG. 6 is a schematic diagram that depicts an inkjet imaging apparatus in accordance with yet another embodiment of the present invention.

Turning now to FIG. 6, a schematic diagram is shown which depicts an inkjet imaging apparatus 600 in accordance with an additional embodiment of the present invention. A study of FIG. 6 reveals that the inkjet imaging apparatus 600 can be somewhat similar to the apparatus 200 and 400 which have been discussed above with respect to FIGS. 2 through 5. More specifically, the inkjet imaging apparatus 600 is configured to produce an image (not shown) on an imaging media. The apparatus 600 includes a print head 110 that has a side 112 and that defines a nozzle area 114. An ink nozzle 116 (shown in FIG. 1) is located in the nozzle area 114. The inkjet imaging apparatus 600 also comprises an actuating mechanism 210 that is configured to bring the nozzle area 114 and the imaging media M into contact with one another to facilitate cleaning of the nozzle area and of the ink nozzle.

The inkjet imaging apparatus 600 preferably comprises a lateral positioning mechanism 220 which has been described above with reference to the apparatus 200 and 400. The apparatus 600 also preferably includes a feed mechanism 240 as well as a chassis 250. Both the feed mechanism 240 and the chassis 250 have been described above with respect to the apparatus 200 and 400. A media path MP is also preferably included in the apparatus 600. Preferably, the print head 110 is supported on the lateral positioning mechanism 220, while the lateral positioning mechanism is, in turn, supported on the chassis 250. Also, the actuating mechanism 210 is supported on the chassis 250, as is preferably the feed mechanism 240.

Figure 7:
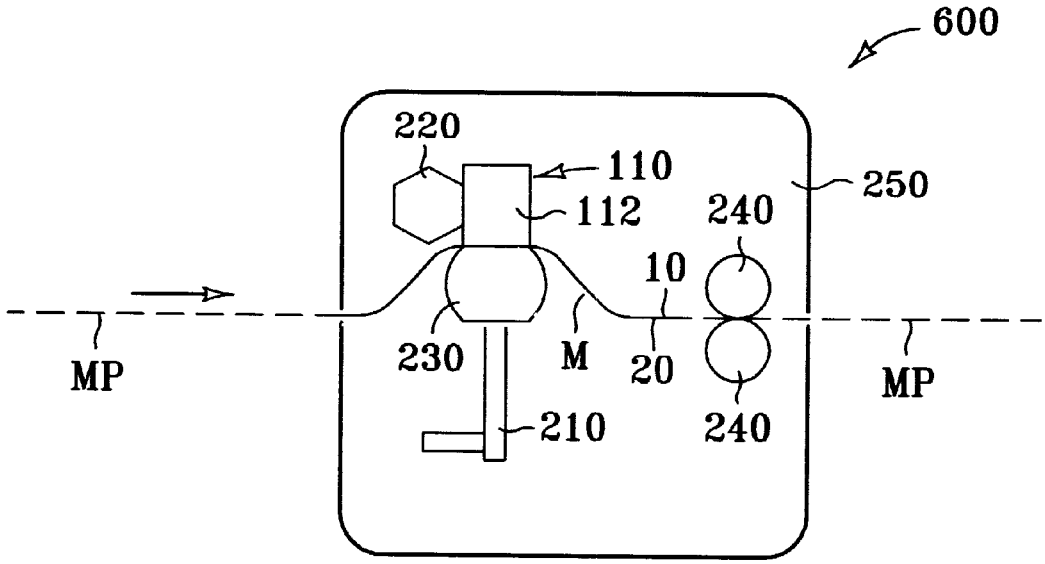
FIG. 7 is a schematic diagram of the inkjet imaging apparatus that is depicted in FIG. 6, and which shows movement of the backup object.

Now turning to FIG. 7, a schematic diagram is shown which depicts the inkjet imaging apparatus 600 which is depicted in FIG. 6. As is evident from a study of FIG. 7, the inkjet imaging apparatus 600 also comprises a backup object 230. The actuating mechanism 210 of the apparatus 600 is configured to move the backup object 230 into contact with the imaging media M, and thereby bring the imaging media into contact with the nozzle area 114 (shown in FIG. 6) to facilitate cleaning of the nozzle area and the ink nozzle 116 (shown in FIG. 1). That is, the backup object 230 is preferably supported on the actuating mechanism 210 so that the actuating mechanism can move the backup object against the second side 20 of the imaging media M, and thereby to bring the first side 10 of the imaging media into contact with the nozzle area 114.

Furthermore, the lateral positioning mechanism 220 is preferably configured to move the nozzle area 114 across the first side 10 of the imaging media M while the nozzle area is in contact therewith to facilitate cleaning of the nozzle area and/or the ink nozzle 116 (shown in FIG. 1). In other words, as is evident from a study of FIGS. 6 and 7, the apparatus 600 is configured such that the backup object 230 can be moved against the second side 20 of the imaging media M in order to move at least a portion of the imaging media relative to the chassis 250 and against the print head 110, wherein the imaging media is sandwiched between the backup object and the nozzle area 114.

The lateral positioning mechanism 220 of the apparatus 600 is preferably configured to move the nozzle area 114 across the first side 10 of the imaging media M while the nozzle area is in contact with the first side of the imaging media to facilitate cleaning of the nozzle area and the ink nozzle 116 (shown in FIG. 1). That is, the lateral positioning mechanism 220 is preferably configured to move the print head 110 in a transversal, or lateral, direction relative to the media path MP while the nozzle area 114 is in contact with the first side of the imaging media M and the backup object 230 is in contact with the second side 20 of the imaging media.

In operation, the print head 110 of the inkjet imaging apparatus 600 is preferably caused to spray an ink area (not shown) onto the first side 10 of the imaging media M before the imaging media is moved into contact with the nozzle area 114. Before the ink area is dry, the actuating mechanism 210 is preferably caused to move the backup object into contact with the second side 20 of the imaging media M so as to push, or move, the imaging media off the media path MP and toward the print head 110. The actuating mechanism 210 preferably continues to move the backup object 230 against the imaging media M in such a manner until the imaging media is sandwiched between the backup object and the nozzle area 114.

Preferably, the result of the above-described action is that the nozzle area 114 is brought into contact with the wet ink area on the first side 10 of the imaging media M, while the backup object 230 contacts and supports the second side 20 of the imaging media. Additionally, the lateral positioning mechanism 220 is preferably caused to move the print head 110, and thus the nozzle area 114, across the first side 10 of the imaging media M and through the wet ink area in a substantially transversal direction relative to the media path MP while the nozzle area is in contact with the first side of the imaging media. This movement of the nozzle area 114 relative to the imaging media M while in contact therewith results in a sliding, or rubbing, of the nozzle area against the imaging media. As mentioned above, such a sliding or rubbing movement of the nozzle area 114 against the imaging media M can facilitate cleaning of the nozzle area and the ink nozzle 116 (shown in FIG. 1).

In accordance with yet another embodiment of the present invention, a method of cleaning a nozzle area and an ink nozzle of a print head is disclosed. The print head forms a portion of an inkjet imaging apparatus that is configured to produce an image on an imaging media. The inkjet imaging apparatus can be, for example, any of the inkjet imaging apparatus 200, 400, and 600 which are described above. The print head can be the print head 110 that is described above. Likewise, the nozzle area can be, for example, the nozzle area 114, while the ink nozzle can be the ink nozzle 116 which are both shown and described above. The method includes moving the nozzle area into contact with the imaging media. Such contact of the nozzle area with the imaging media can facilitate cleaning of the nozzle area and/or the ink nozzle.

The method can also include moving the print head laterally across the imaging media while the nozzle area is in contact with the imaging media. The method can also include spraying an area of ink onto the imaging media. The nozzle area is preferably in contact with the area of ink while the print head is moved laterally across the imaging media. Preferably, the area of ink is wet while the nozzle area is in contact with the area of ink. Such movement of the print head laterally across the imaging media while the nozzle area is in contact with the wet area of ink can further facilitate cleaning of the nozzle area and/or the ink nozzle.

In accordance with yet an additional embodiment of the present invention, another method of cleaning the nozzle area and the ink nozzle of the print head is disclosed. As in the previously discussed method, the print head forms a portion of the imaging apparatus which is configured to produce an image on an imaging media. The method includes moving the imaging media into contact with the nozzle area. This is contrasted with the previously described method, wherein the nozzle area is moved into contact with the imaging media.

In addition to moving the imaging media into contact with the nozzle area, the method can also include moving the print head laterally across the imaging media while the imaging media is in contact with the nozzle area. Additionally, the method can comprise spraying an area of ink onto the imaging media. The nozzle area is preferably in contact with the area of ink while the print head is moved laterally across the imaging media. More preferably, the ink area is wet while the nozzle area is in contact with the ink area. As mentioned above, such movement of the nozzle area across the imaging media while in contact therewith and also while in contact with the wet ink area can facilitate cleaning of the nozzle area and of the ink nozzle.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An inkjet imaging apparatus configured to produce an image on an imaging media, the apparatus comprising:

a print head defining a nozzle area and having an ink nozzle located in the nozzle area; and, an actuating mechanism operatively connected with the print head, whereby the nozzle area and the imaging media are brought into contact with one another, thereby facilitating cleaning of the nozzle area and the ink nozzle.

2. An inkjet imaging apparatus configured to produce an image on an imaging media, the apparatus comprising:

a print head defining a nozzle area and having an ink nozzle located in the nozzle area; and, an actuating mechanism operatively connected with the print head, whereby the print head is moved to bring the nozzle area into contact with the imaging media, thereby facilitating the cleaning of the nozzle area and the ink nozzle.

3. The inkjet imaging apparatus of claim 2, and further comprising a lateral positioning mechanism operatively connected with the print head, whereby the print head is moved across the imaging media while the nozzle area is in contact therewith.

4. An inkjet imaging apparatus configured to produce an image on an imaging media, the apparatus comprising:

a print head defining a nozzle area and having an ink nozzle located in the nozzle area;

a backup object; and, an actuating mechanism operatively connected with the backup object, whereby the backup object is moved into contact with the imaging media, thereby bringing the imaging media into contact with the nozzle area and facilitating the cleaning of the nozzle area and the ink nozzle.

5. The inkjet imaging apparatus of claim 4, and further comprising a lateral positioning mechanism operatively connected with the print head, whereby the print head is moved across the imaging media while the nozzle area is in contact therewith.

6. The inkjet imaging apparatus of claim 4, and wherein the backup object is substantially in the form of a roller.

7. The inkjet imaging apparatus of claim 4, and wherein the backup object is substantially in the form of a plate.

8. An inkjet imaging apparatus, comprising:

a chassis;

a media path along which an imaging media is conveyable relative to the chassis;

an actuating mechanism supported on the chassis;

a lateral positioning mechanism supported on the actuating mechanism; and, a print head defining a nozzle area and having an ink nozzle located in the nozzle area, wherein:

the print head is supported on the lateral positioning mechanism;

the actuating mechanism is operable, whereby the nozzle area is moved into contact with the imaging media; and, the lateral positioning mechanism is operable, whereby the nozzle area is moved across the imaging media while the nozzle area is in contact therewith, thereby facilitating the cleaning of the nozzle area and the ink nozzle.

9. The inkjet imaging apparatus of claim 8, and further comprising a backup object supported on the chassis, wherein:

the imaging media has a first side and an opposite second side;

the actuating mechanism is operable, whereby the nozzle area is moved into contact with the first side; and, the backup object is positioned relative to the imaging media and print head, whereby operation of the actuating mechanism brings the imaging media into supportive contact with the second side of the imaging media substantially opposite of the nozzle area, wherein the imaging media is sandwiched between the backup object and the nozzle area.

10. An inkjet imaging apparatus, comprising:

a chassis:

a media path along which an imaging media is conveyable relative to the chassis;

a lateral positioning mechanism supported on the chassis;

an actuating mechanism supported on the lateral positioning mechanism; and, a print head defining a nozzle area and having an ink nozzle located in the nozzle area, wherein:

the print head is supported on the actuating mechanism;

the actuating mechanism is operable, whereby the nozzle area is moved into contact with the imaging media; and, the lateral positioning mechanism is operable, whereby the nozzle area is moved across the imaging media while the nozzle area is in contact therewith, thereby facilitating the cleaning of the nozzle area and the ink nozzle.

11. The inkjet imaging apparatus of claim 10, and further comprising a backup object supported on the chassis, wherein:

the imaging media has a first side and an opposite second side;

the actuating mechanism is operable, whereby the nozzle area is moved into contact with the first side of the imaging media; and, the backup object is positioned relative to the imaging media and print head, whereby operation of the actuating mechanism brings the imaging media into supportive contact with the second side of the imaging media substantially opposite of the nozzle area, wherein the imaging media is sandwiched between the backup object and the nozzle area.

12. An inkjet imaging apparatus, comprising:

a chassis;

a media path along which an imaging media is conveyable relative to the chassis, wherein the imaging media has a first side and an opposite second side;

an actuating mechanism supported on the chassis;

a backup object supported on the actuating mechanism;

a lateral positioning mechanism supported on the chassis;

a print head defining a nozzle area and having an ink nozzle located in the nozzle area, wherein:

the print head is supported on the lateral positioning mechanism;

the actuating mechanism is operable, whereby the backup object is moved against the second side of the imaging media, thereby bringing the first side of the imaging media into contact with the nozzle area; and, the lateral positioning mechanism is operable, whereby the nozzle area is moved across the first side of the imaging media while the nozzle area is in contact therewith, thereby facilitating the cleaning of the nozzle area and the ink nozzle.

13. A method of cleaning a nozzle area and an ink nozzle of a print head that forms a portion of an inkjet imaging apparatus which is configured to produce an image on an imaging media, the method comprising moving the nozzle area into contact with the imaging media.

14. The method of claim 13, and further comprising moving the print head laterally across the imaging media while the nozzle area is in contact with the imaging media.

15. The method of claim 14, and further comprising spraying an area of ink onto the imaging media, wherein the nozzle area is in contact with the area of ink while the print head is moved laterally across the imaging media.

16. The method of claim 15, and wherein the area of ink is wet.

17. A method of cleaning a nozzle area and an ink nozzle of a print head that forms a portion of an imaging apparatus which is configured to produce an image on an imaging media, the method comprising moving the imaging media into contact with the nozzle area.

18. The method of claim 17, and further comprising moving the print head laterally across the imaging media while the imaging media is in contact with the nozzle area.

19. The method of claim 18, and further comprising spraying an area of ink onto the imaging media, wherein the nozzle area is in contact with the area of ink while the print head is moved laterally across the imaging media.

20. The method of claim 19, and wherein the area of ink is wet.

* * * * *